US005808226A

United States Patent [19]

Allen et al.

[11] Patent Number: 5,808,226

[45] Date of Patent: Sep. 15, 1998

[54] GRENADE SHELL LASER SYSTEM

[75] Inventors: Michael S. Allen, Albuquerque, N. Mex.; Andreas G. Keipert, Wessling, Germany; John D. German, Jr., Cedar Crest; Mark W. Gaddis, Albuquerque, both of N. Mex.

[73] Assignee: United States of America as represented by the Secretary of the Air Force, Washington, D.C.

[21] Appl. No.: 573,858

[22] Filed: Dec. 18, 1995

[51] Int. Cl.[6] ..... F41G 1/34

[52] U.S. Cl. ..... 89/1.11; 42/103; 42/105

[58] Field of Search ..... 89/1.11; 42/103, 42/105; 362/111–114; 434/21, 22

[56] References Cited

U.S. PATENT DOCUMENTS

| | | | |
|---|---|---|---|
| 1,149,705 | 8/1915 | Ward | 362/114 |
| 1,645,881 | 10/1927 | Strong | 362/111 |
| 3,732,412 | 5/1973 | Tyroler | 89/1.11 |
| 3,733,727 | 5/1973 | Jones et al. | 42/105 |
| 3,739,167 | 6/1973 | Avery | 42/103 |
| 3,898,747 | 8/1975 | Marshall | 273/101.1 |
| 4,367,516 | 1/1983 | Jacob | 362/111 |
| 4,678,437 | 7/1987 | Scott et al. | 434/21 |
| 4,830,617 | 5/1989 | Hancox et al. | 42/103 |
| 4,842,277 | 6/1989 | LaCroix | 361/232 |
| 5,243,894 | 9/1993 | Minovitch | 89/1.11 |
| 5,363,769 | 11/1994 | Bellak et al. | 42/105 |
| 5,488,795 | 2/1996 | Sweat | 42/103 |
| 5,555,662 | 9/1996 | Teetzel | 42/103 |

FOREIGN PATENT DOCUMENTS

| | | | |
|---|---|---|---|
| 644996 | 1/1979 | U.S.S.R. | 42/103 |

*Primary Examiner*—Stephen M. Johnson
*Attorney, Agent, or Firm*—Robert L. Nathans

[57] ABSTRACT

A conventional grenade shell launcher contains a laser generator shell therein which directs a blinding flash of light at an adversary to temporarily induce blindness of the adversary carrying out unlawful or dangerous actions such as pointing a weapon at police officers or others. The laser generator shell can be rapidly removed from the launcher, and conventional tear gas grenades or the like can be fired by the grenade launcher at the adversary to induce his surrender. This mode of operation is enabled by detachably coupling a laser triggering transmitter to the launcher. The wide angle light beam directed at the adversary also eliminates the need to accurately aim the device to disable the adversary.

18 Claims, 1 Drawing Sheet

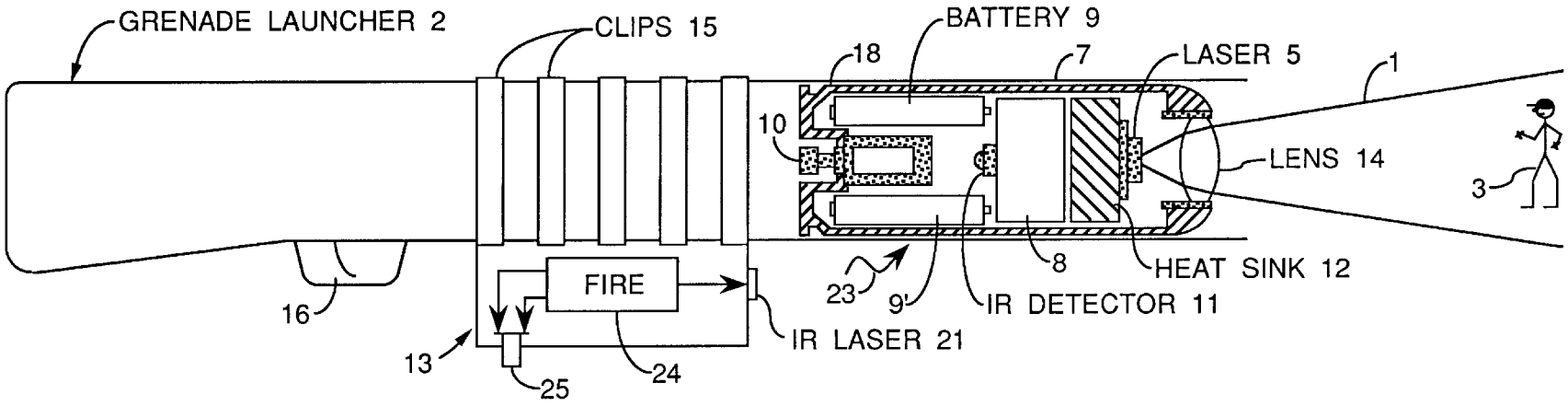
3
1
LENS 14
LASER 5
HEAT SINK 12
IR DETECTOR 11
BATTERY 9
7
8
9
IR LASER 21
18
23
10
CLIPS 15
FIRE
24
25
13
GRENADE LAUNCHER 2
16

GRENADE SHELL LASER SYSTEM

STATEMENT OF GOVERNMENT INTEREST

The invention described herein may be manufactured and used by or for the Government for governmental purposes without the payment of any royalty thereon.

BACKGROUND OF THE INVENTION

A need exists for a non-lethal method of dealing with adversaries in civilian police encounters, which deters the criminal from aiming a gun or the like at arresting officers, or which otherwise aids in the arrest. Such a method, which could also be utilized for crowd or mob control, and for military use should be relatively inexpensive to implement, and preferably uses a conventional, mass produced, and widely available M-203 grenade launcher. Other actions of an adversary that can be deterred by such a method include opening doors or gates, planting and arming explosives, identifying an escape route or driving a vehicle, or using night vision devices.

BRIEF SUMMARY OF PREFERRED EMBODIMENTS OF THE INVENTION

The invention provides a grenade shell launcher including a laser generator contained within a grenade shell for illuminating a distant object and energizing means for actuating the laser means.

In accordance with an embodiment of the invention, a compact, lightweight, hand-held and eye-safe laser system induces temporary visual impairment (eg. glare and/or flash blinding) of an adversary. A high brightness diode laser is housed in a 40 mm grenade shell, in turn inserted into a conventional grenade shell launcher. A trigger signal transmitter is detachably clipped to the grenade launcher and when activated, causes the laser in the grenade shell to direct a beam of red light at the adversary to temporarily induce visual impairment, which tends to incapacitate the adversary to deter him from aiming or reloading a weapon for example. The laser grenade shell containing the laser is not fired from the launcher but can be ejected and replaced by conventional grenades, which can be fired by the grenade launcher at the adversary, if appropriate. The laser grenade shell can be again inserted into the launcher to be used as before to temporarily blind the adversary. The beam of light is substantially diverging so that accurate aiming is not required. Other applications include a laser designator for laser guided munitions, cargo drop zones, nightime illumination, and as a countermeasure to night vision devices.

BRIEF DESCRIPTION OF THE DRAWING

Other objects, features and advantages of the invention will become apparent upon study of the following description taken in conjunction with the drawing, illustrating a preferred embodiment of the invention, using a conventional, widely available, grenade launcher that need not be modified, thereby to save costs of implementing the method of the invention.

DETAILED DESCRIPTION OF PREFERRED EMBODIMENTS OF THE INVENTION

A conventional M203 grenade launcher 2 is aimed at an adversary 3, and a laser beam 1 is directed at the adversary to temporarily blind him. Beam 1 is generated by a laser diode 5 for producing bright red light, and which is energized by batteries 9, 9', and laser control circuit 8, electrically coupled to laser diode 5. These components constitute a laser generator means within laser generating aluminum grenade shell 7. An IR detector 11 is provided for detecting a radiated IR trigger signal 23 for triggering the laser diode 5. Detachable radiant energy (IR) transmitter means 13 is detachably clipped to the grenade launcher by spring clips 15, and includes semiconductor IR LED 21, which radiates IR trigger signal 23 to IR radiant energy detector 11. This action is in response to actuating firing button 25 to cause firing circuit 24 to actuate IR laser diode 21. Initially, arming switch 10 is actuated when the shell 7 is inserted into the grenade launcher. Hence, a laser generator triggering means is provided including IR emitting laser diode 21, IR detector 11 and the remaining components 24 and 25 in detachable unit 13.

Laser beam 1 is generally a wide angle laser beam having substantial divergence, to prevent permanent eye damage, and additionally to eliminate the need for accurately aiming the grenade launcher at the adversary. The divergence of the beam may be adjusted by conventional rotatable lens means 14 as is well understood in the art.

Adjustment is performed to enable the beam, if fired, to temporarily blind the adversary to disable him. Should the adversary refuse to surrender, or otherwise act in a hostile fashion, he will continue to be temporarily blinded by beams 1 upon each activation of firing switch 25, to prevent him from accurately aiming a weapon at an approaching arresting officer. The temporary blinding or glare, is similar to sensations following viewing of bright headlights at night, or following the use of a camera flashbulb for taking indoor pictures. The effect is not lasting, and does no permanent harm. It is important to prevent unintended operation of the laser at close range which could permanently blind a criminal suspect being arrested by the police. One way to prevent this is to provide a mechanical stop (not shown) on the lens barrel of the lens adjustment means 14, to prevent undue narrowing of the beam 1, causing unacceptable high intensity levels of light to be projected upon the adversary. The initial triggering of the beam also acts as a warning device to inform him that a weapon is trained on him.

Should the situation deteriorate into a battle, the laser light generating grenade shell 7 is rapidly removed from the launcher by ejection, and replaced by a convention conventional grenade, which at least for civilian encounters, would be a grenade which is not intended to permanently harm the adversary, such as a tear gas grenade, or concussion or smoke grenade. The grenade is fired by actuation of grenade launcher trigger 16 of the M203 grenade launcher, in the conventional manner. If appropriate, the light generating shell may again be reinserted into the grenade launcher, to employ the laser beam to again attempt to disable the adversary as described. This capability of rapidly interchanging the two types of grenade shells, is facilitated by the use of the radiated IR trigger signal 23, detected by IR detector 11 to cause actuation of the laser 5 directed at the adversary. The laser generator shell 7 includes an IR transmissive translucent wall portion 18 to deter attenuation of the trigger signal 23 on its path to IR detector 11. Arming switch 10 may be employed to enable laser operation once the laser shell is inserted into the grenade launcher, and a heat sink 12 may be utilized if appropriate. Additionally, the launcher can also be used as a laser designator for pointing the beam at distant objects without using the conventional grenades for battle purposes as previously mentioned.

It will be obvious to skilled workers in the art that variations in the above can be made within the spirit of the invention, and thus the scope of the invention is to be defined solely by the terms of the following claims and art recognized equivalents thereof. For example, the term "grenade" includes the conventional grenade used by the military, and other types for civilian applications, that do no permanent harm such as tear gas; concussion, smoke grenades and others. The light projected at the target may have suitable wavelengths other than wavelengths in the red. Also, radiant energy trigger signal could be virtually any electromagnetic radiation, or even sonic energy such as ultrasonic sound.

What is claimed is:

1. A method of disabling an adversary comprising the steps of:

(a) providing person with a grenade shell launcher having a laser generator means for temporarily visually impairing an adversary;

(b) pointing said grenade shell launcher at said adversary;

(c) energizing said laser generator means; and thereafter (d) using said grenade launcher to fire a disabling but non-lethal grenade at said adversary.

2. The method of claim 1 including the step of inserting a laser beam transmitting grenade shell into said grenade shell launcher before performing steps (b) and (c) and thereafter removing said laser beam transmitting grenade shell from said grenade launcher before performing step (d).

3. A laser system comprising:

(a) a grenade shell launcher for containing a laser generator means within a grenade shell envelope in turn contained within said grenade shell launcher; and (b) radiant energy triggering means for actuating said laser generator means by the radiation through space of a radiant energy trigger signal thereto.

4. The laser system of claim 3 wherein said triggering means includes a radiant energy detector means for actuating said laser generator means in response to the receipt of said a radiant energy trigger signal, together with radiant energy transmitter means for transmitting the radiant energy trigger signal to said radiant energy detector means.

5. The laser system of claim 4 wherein said radiant energy transmitter means is detachably coupled to said grenade shell launcher.

6. The laser system of claim 5 wherein said radiant energy transmitter means transmits infrared energy to said radiant energy detector means.

7. The laser system of claim 5 wherein said laser generator means includes beam adjusting means for projecting a wide angle laser beam at an adversary to prevent the need for accurately aiming said grenade shell launcher.

8. The laser system of claim 4 wherein said radiant energy transmitter means transmits infrared energy to said radiant energy detector means.

9. The laser system of claim 8 wherein said laser generator means includes beam adjusting means for projecting a wide angle laser beam at an adversary to prevent the need for accurately aiming said grenade shell launcher.

10. The laser system of claim 8 wherein said laser generator means is contained within a grenade shell insertable into said grenade shell launcher.

11. The laser system of claim 4 wherein said laser generator means includes beam adjusting means for projecting a wide angle laser beam at an adversary to prevent the need for accurately aiming said grenade shell launcher.

12. The laser system of claim 11 wherein said laser generator means is contained within a grenade shell insertable into said grenade shell launcher.

13. The laser system of claim 12 wherein said radiant energy detector means is mounted upon said grenade shell.

14. The laser system of claim 4 wherein said laser generator means is contained within a grenade shell insertable into said grenade shell launcher.

15. The laser system of claim 14 wherein said radiant energy detector means is mounted upon said grenade shell.

16. The laser system of claim 3 wherein said laser generator means includes beam adjusting means for projecting a wide angle laser beam at an adversary to prevent the need for accurately aiming said grenade shell launcher.

17. The laser system of claim 3 wherein said laser generator means is contained within a grenade shell insertable into said grenade shell launcher.

18. A method of disabling an adversary comprising the steps of:

(a) providing a person with a grenade shell launcher having a laser generator means for temporarily visually impairing an adversary;

(b) pointing said grenade shell launcher at said adversary;

(c) energizing said laser generator means;

(d) thereafter using said grenade launcher to fire a grenade at said adversary; and (e) inserting a laser beam transmitting grenade shell into said grenade shell launcher before performing steps (b) and (c) and thereafter removing said laser beam transmitting grenade shell from said grenade shell launcher before performing step (d).

* * * * *